United States Patent [19]

Ho

[11] Patent Number: 4,774,730

[45] Date of Patent: Oct. 4, 1988

[54] TOILET BOWL SPLASH-PROOF DEVICE

[76] Inventor: Ming J. Ho, No. 148, Sec. 2, Chuang Ching Road, Tao Yuan City, Taiwan

[21] Appl. No.: 71,181

[22] Filed: Jul. 8, 1987

[51] Int. Cl.[4] ..... E03D 9/00

[52] U.S. Cl. ..... 4/300.3; 210/131

[58] Field of Search ..... 4/300.3, 661; 210/285, 210/521, 131, 242.1

[56] References Cited

U.S. PATENT DOCUMENTS 906,562 12/1908 Rue ..... 210/131

4,010,497 3/1977 Menter et al. ..... 4/300.3

FOREIGN PATENT DOCUMENTS 2077791 12/1981 United Kingdom ..... 4/300.3

*Primary Examiner*—Charles E. Phillips

*Attorney, Agent, or Firm*—Morton J. Rosenberg

[57] ABSTRACT

A splash-proof device especially designed for but not limited to be using in a toilet bowl to prevent splash of soil water. The device includes a gutter ring having on the circumference thereof a plurality of segments between every two of which there is a segmental divider. A plurality of long arms and short arms are alternately snap-fitted onto corresponding segments so that the swinging amplitude thereof are confined within a predetermined range. Consequently, in case the feces fall onto the water surface between the arms, the surface area is too small to allow the occurrence of splashing, and provided the feces fall onto the arms of the gutter ring, the arms will provide a cushioning function thereby reducing the pulsive force of the falling feces and therefore, preventing the water from splashing upwards.

5 Claims, 8 Drawing Sheets

TOILET BOWL SPLASH-PROOF DEVICE

BACKGROUND OF THE INVENTION

This invention is directed to a toilet bowl splash-proof device to suppress splash.

Various attempts such as shown in U.S. Pat. No. 3,383,710 in the past have been made to prohibit splash associated with the deposit of body wastes in toilets with varying degrees or practicality and success. The U.S. pat. demonstrates the application of foam to the commode water such as by using a small-bubbled, short lived foam. However, a practical solution to the splash has not been satisfactorily determined and it is one goal of the present invention to provide a toilet bowl splash-proof device which will be both economical in cost and practical in application.

It is another objective of the present invention to provide a splash-proof device which will greatly reduce the splash as human waste is deposited in toilet bowls.

It is still another objective of the present invention to provide a splash-proof device which can be retrofitted to existing toilet bowls.

It is yet another objective of the present invention to provide a splash-proof device which is simple in construction.

Other objects and merits and a fuller understanding of the present invention will be obtained by those having ordinary skill in the art when the following detailed description has been read in conjunction with the accompanying drawings wherein like numerals refer to like or similar parts.

SUMMARY OF THE INVENTION

The aforesaid and other objectives of the invention are accomplished by providing a conventional toilet bowl with a gutter ring which will provide a cushion effect against the falling human wastes and decelerate the speed thereof consequently preventing the water in the bowl to splash upwards. The gutter ring interferes with any pulsive force such as occurs by a deposit of solid waste materials from above the water contained within the bowl. Splash is thus greatly reduced as the energy from the falling objects strike the gutter ring thereby dispersing or scattering the kinetic energy.

The novel features which are characteristics of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and are intended as a definition of the limits of the invention.

DETAILED DESCRIPTION OF THE PREFERRED EMBODIMENT

Figure 1:
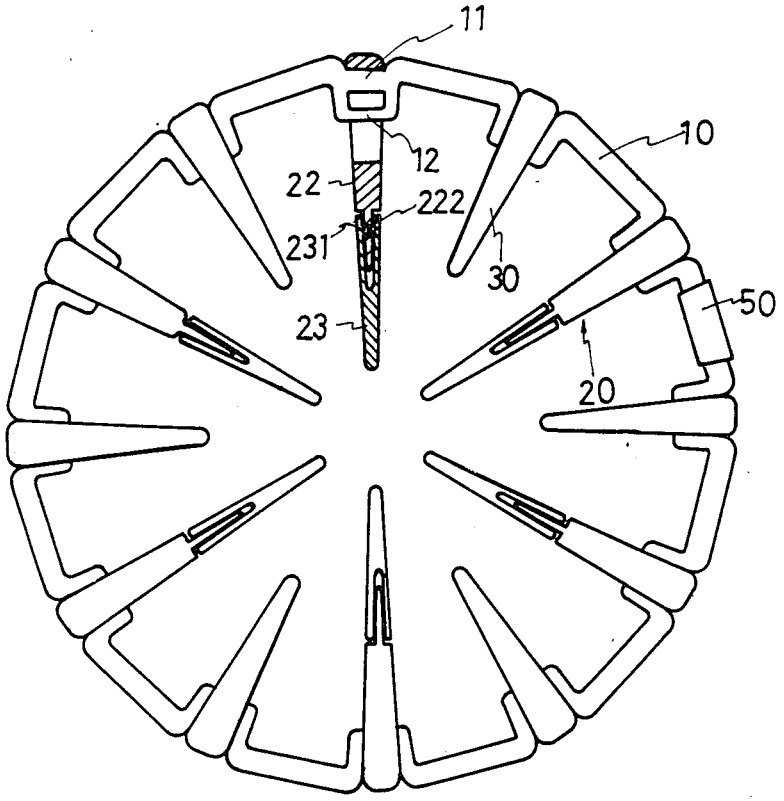
FIG. 1 is a top view of the present invention.

For purposes of promoting an understanding of the principles of the invention, reference will now be made to the embodiment illustrated in the drawings. Specific language will be used to describe same. It will, nevertheless, be understood that no limitation of the scope of the invention is thereby intended, such alternations and further applications of the principles of the invention as illustrated herein being contemplated as would normally occur to one skilled in the art to which the invention relates.

Figure 2A:
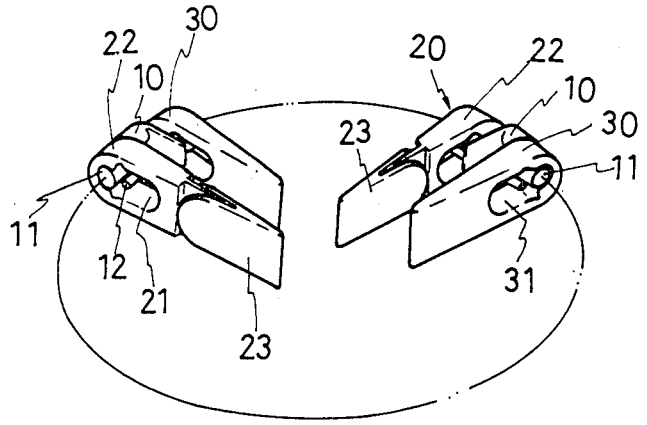
FIG. 2A shows a portion of the present invention.
Figure 2B:
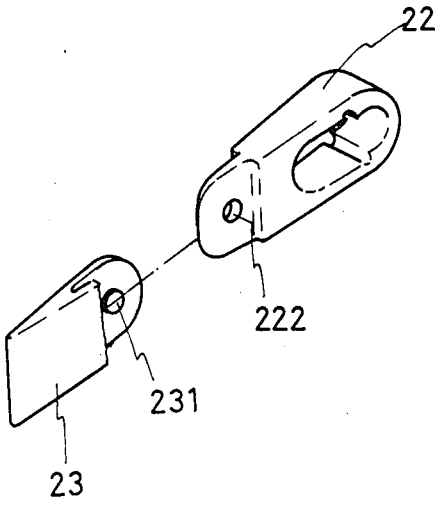
FIG. 2B shows the construction of the long arm of the present invention.
Figure 3:
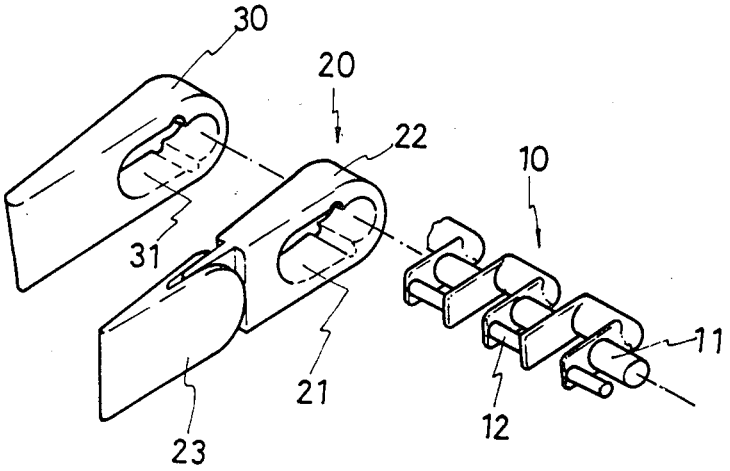
FIG. 3 is fragmentary exploded view of the present invention.
Figure 4A:
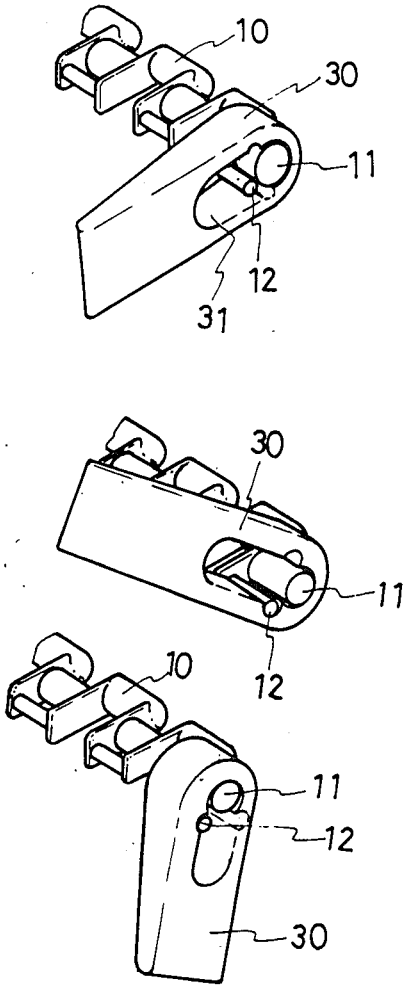
FIG. 4 shows the swinging angle and motion of the arms of the gutter ring according to the present invention.
FIG. 4B shows the function of the long arms.
Figure 4B:
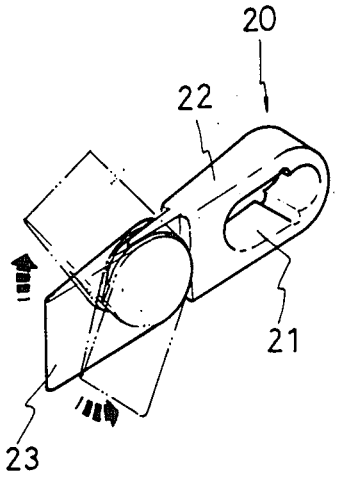
Figure 5:
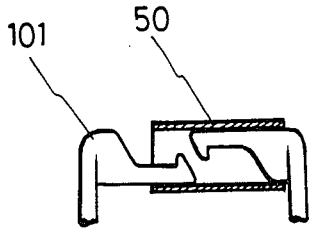
FIG. 5 shows the connection of the gutter ring.
Figure 6:
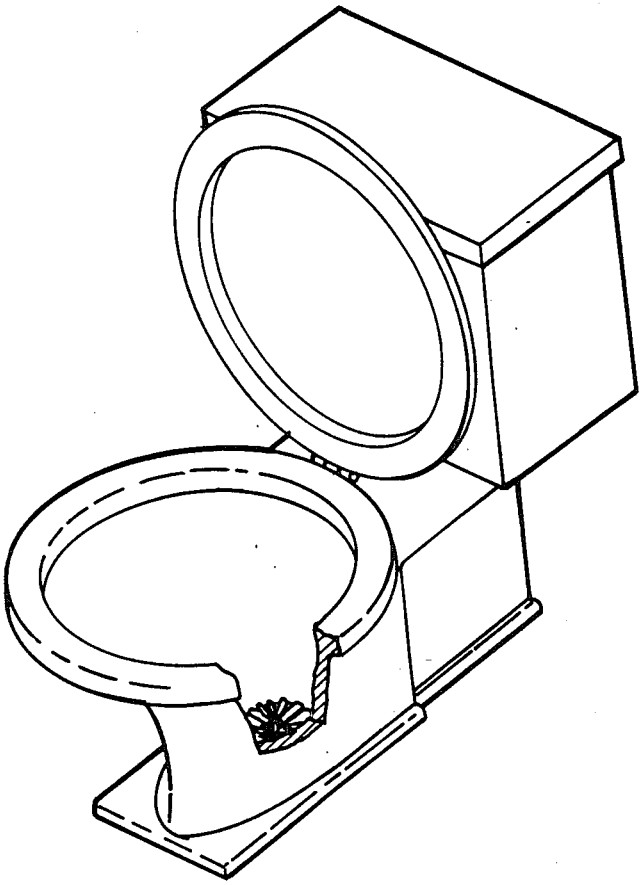
FIG. 6 is a working view of the present invention.

With reference now to the drawings and in particular to FIGS. 1, 2 and 3 thereof, the toilet bowl splash-proof device according to the present invention comprises a gutter ring 10 which is generally circular in shape and preferably made of plastic material so that it may float and turn over in the water received in a toilet bowl. The circumference of the gutter ring 10 is formed with a plurality of segments 11 between each of which there is a segmental divider. Each of the segments 11 has a limiting bar integrally formed in the inner side thereof and in parallel therewith. The gutter ring 11 is first formed into a chain-like member and then the two ends 101 thereof are snap-fitted together by a ferrule 50 to form a closed circular member (see FIG. 5). It should be noted, however, that the gutter ring 10 may be formed into a unitary member by injection molding. Moreover, the diameter of the gutter ring 11 is larger than that of the drain hole of the toilet bowl hence preventing the gutter ring to be washed away by the flashing water.

A plurality of long arms 20 and short arms 30 are alternately disposed on the segments 11 of the gutter ring 10 with their free ends pointing towards the center thereof. The long arm 20 is composed of a main portion 22 and an auxiliary portion 23 which has a pin 231 engaged with a hole 222 of the main portion so that the auxiliary portion 23 may freely rotate with respect to the main portion 22 thereby preventing the tissue or the like from attaching on the present invention. Each of the short arms 30 and the main portion 22 of the long arms 20 is provided with a clover leaf-shaped hole 21 the top of which is snap-fitted into segment 11 and the two sides of which are designed to limit the swinging amplitude of the arm.

When in use, simply put the splash-proof device into the toilet bowl. When the faces fall onto the water surface between the arms 20 and 30 of the gutter ring 11, the area of the water surface is too small to allow the occurrence of splashing and in case the feces fall onto the arms of the gutter ring 11, the arms 20 and 30 will provide a cushioning function thereby reducing the pulsive force of the falling feces and therefore, preventing the water from splashing upwards.

Although this invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A toilet bowl splash-proof device comprising:

a gutter ring generally circular in shape having on the circumference thereof a plurality of segments between every two of which there is a segmental divider, each said segment having a limiting bar disposed at the inner side thereof and in parallel therewith;

a plurality of long arms each including a main portion and an auxiliary portion which has a pin engaged with a hole of the main portion so that the auxiliary portion may freely rotate with respect to the main portion thereby preventing tissue or the like from attaching thereon, the main portion having a clover leaf-shape hole the upper part of which is engageable with a corresponding segment and the two sides of which are designed to limit swinging amplitude of said arms; and a plurality of short arms having an identical clover leaf-shaped hole with the main portion of the long arm and being engaged with a corresponding segment of the gutter ring in the same way as the long arm;

whereby when feces fall onto water surface between the arms of the gutter ring, the area of the water surface is too small to allow the occurrence of splashing and in case the feces fall onto the arms of the gutter ring, the arms will provide a cushioning function thereby reducing the pulsive force of the falling feces and therefore, preventing the water from splashing upwards.

2. A toilet bowl splash-proof device as claimed in claim 1, wherein said gutter ring and said arms are made of plastic material with a specific gravity less than water, and the plastic material is so selected and preferably having the specific gravity such that the device floats just enough to accomplish the pulsive reduction.

3. A toilet bowl splash-proof device as claimed in claim 1, wherein said arms are snapped onto corresponding segments of said gutter ring, and once the arms are snapped onto the segments, they can not be unsnapped.

4. A toilet bowl splash-proof device as claimed in claim 1, wherein said gutter ring is made of a chain-like member the two free ends of which are snap-fitted together to form a closed circular member.

5. A toilet bowl plash-proof device as claimed in claim 1, wherein the inner limiting bars is designed so as to provide limiting function to keep the arms always radially pointing toward center of said gutter ring.

* * * * *